United States Patent [19]

Buenemann, Jr.

[11] Patent Number: 4,867,066

[45] Date of Patent: Sep. 19, 1989

[54] SHOTSHELL CASING WITH REDUCED VOLUME BASEWAD AND INCREASED INTERIOR VOLUME FOR LARGER SHOT LOADS

[75] Inventor: Morris C. Buenemann, Jr., Florissant, Mo.

[73] Assignee: Olin Corporation, Stamford, Conn.

[21] Appl. No.: 260,764

[22] Filed: Oct. 21, 1988

[51] Int. Cl.[4] ..... F42B 5/30

[52] U.S. Cl. ..... 102/470; 102/448; 102/466; 102/467

[58] Field of Search ..... 86/36–38, 86/10, 1.1; 102/448–461, 469, 470, 472

[56] References Cited

U.S. PATENT DOCUMENTS

| | | | |
|---|---|---|---|
| 855,958 | 6/1907 | Loeble | 102/467 |
| 3,099,958 | 8/1963 | Daubenspeck et al. | 102/467 |
| 3,283,720 | 11/1966 | Foote et al. | 102/450 |
| 3,614,929 | 10/1971 | Herter et al. | 102/466 |
| 3,722,412 | 3/1973 | Herter | 102/466 |
| 3,786,755 | 1/1974 | Eckstein et al. | 102/467 |

FOREIGN PATENT DOCUMENTS

| | | | |
|---|---|---|---|
| 789274 | 7/1968 | Canada | 102/449 |
| 328008 | 8/1903 | France | 102/467 |
| 783023 | 9/1957 | United Kingdom | 102/466 |
| 1096658 | 12/1967 | United Kingdom | 102/469 |

*Primary Examiner*—Harold J. Tudor
*Attorney, Agent, or Firm*—Bruce E. Burdick

[57] ABSTRACT

An improved reduced volume plastic basewad for a shotshell casing includes a generally solid cylindrical plastic body portion, an annular outer continuous skirt portion merging integrally and upwardly from the body portion, and a raised annular inner continuous hub portion merging integrally and upwardly from the body portion. The skirt and body portions define a continuous exterior surface sized relative an interior surface of a plastic tube of the casing for tightly frictionally fitting within the tube at a bottom end portion thereof providing a gas seal with the tube interior surface. The hub and body portions define a continuous interior surface forming an elongated pocket for receiving a primer in a tight frictional fitting relation in the pocket with an upper end of the primer disposed adjacent an upper end of the hub portion. The hub and skirt portions are radially spaced from one another and define respective exterior and interior surfaces which merge with an upper surface of the body portion so as to define therebetween and above the body portion an annular continuous concavity for containing a portion of a propellant charge placed in the tube below and rearwardly of the top end of the primer so as to thereby increase the interior shot load holding volume of the tube.

18 Claims, 2 Drawing Sheets

SHOTSHELL CASING WITH REDUCED VOLUME BASEWAD AND INCREASED INTERIOR VOLUME FOR LARGER SHOT LOADS

BACKGROUND OF THE INVENTION

1. Field of the Invention

The present invention generally relates to shotshells and, more particularly, is concerned with a shotshell casing having a reduced volume basewad producing increased interior volume for housing a larger non-toxic shot load.

2. Description of the Prior Art

One conventional shotshell includes a casing composed of an elongated plastic tube, a metal primer, a cylindrical plastic basewad, and a cup-shaped metal head. The plastic basewad is inserted in a tight fitting relation in the bottom end portion of the tube. The bottom end portion of the tube with the basewad therein are placed inside of the metal head and mechanically locked to the head by a crimp formed into a peripheral rim at the base of the head. The basewad has a central pocket in which the primer is centrally positioned and frictionally fitted behind a propellant charge placed in the tube. An obturator shot cup containing a load of shot is housed in the tube in front of the propellant charge and the top end of the tube is closed off by an inward fold which extends over the shot load.

A shotshell casing of such construction generally provides sufficient interior volume for a lead shot load. However, due to the toxicity of lead to water fowl and the environment and health concerns about possible retention of lead in game intended for human comsumption, laws have been enacted in many states which substantially limit or even ban the use of traditional lead shot in hunting waterfowl and mandate the use of materials having little or no known toxicity, such as steel. Since steel is not as dense as lead, a larger volume load of steel shot is needed to just equal the weight of the previous lead shot load when use of steel is substituted for lead in shotshells. While the above-described shotshell casing has more than enough interior volume to house the desired load of lead shot, the interior volume is not sufficient when steel shot is substituted.

Consequently, a need exists for a practical approach to increasing the interior volume of the shotshell casing without requiring any significant change in the production equipment used for manufacturing the shotshell casing.

SUMMARY OF THE INVENTION

The present invention provides an improved shotshell basewad designed to satisfy the aforementioned needs. The improved basewad has a unique configuration which results in a reduced volume of space occupied by it in the tube and thereby an increased interior volume available in the shotshell casing for housing a steel shot load. The improved basewad satisfactorily performs all the normal functions of the conventional basewad while requiring a minimum amount of material. The interior volume of the casing available for housing the steel shot load is increased significantly, on the order of five percent. The improved basewad and shotshell casing utilizing the improved basewad can be manufactured on the same production equipment using similar process steps as the prior shotshell casing, resulting in minimal start-up time and cost.

Accordingly, the present invention relates to an improved reduced volume plastic basewad for a shotshell casing. The basewad comprises: (a) a generally solid cylindrical plastic body portion; (b) an annular outer continuous skirt portion merging integrally and upwardly from the body portion; and (c) a raised annular inner continuous hub portion merging integrally and upwardly from the body portion. The hub and body portions of the basewad define a continous interior surface forming an elongated pocket for receiving a primer in a tight fitting relation with an upper end of the primer disposed adjacent an upper end of the hub portion. The hub and skirt portions are radially spaced from one another and define respective exterior and interior surfaces which merge with an upper transverse surface of the body portion so as to define between the hub and skirt portions and above the body portion an annular continuous concavity for holding a portion of the propellant charge, when placed in the tube, below and rearwardly of the top end of the primer so as to thereby increase the interior shot load holding volume of the tube.

Also, in the illustrated embodiment, the basewad is injection molded as a separate part which is placed in a bottom end portion of the plastic tube. The skirt and body portions of the basewad define a continuous exterior surface sized relative to an interior surface of the tube of the casing for tightly frictionally fitting within the tube at the bottom end portion thereof for providing a gas seal with the tube interior surface.

Further, the exterior surface of the hub portion has a cylindrical configuration extending coaxially with respect to a central longitudinal axis of the basewad. The upper transverse surface of the body portion is generally perpendicular to the basewad longitudinal axis. The interior surface of the skirt portion has an inverted truncated conical configuration extending away from the upper transverse surface of the body portion. The upper end of the hub portion has a continuous planar surface bounded by inner and outer edges having rounded configurations.

Still further, the basewad includes an injection molding gate attached to the interior surface of the hub portion within the primer pocket. The gate is spaced below the upper end of the hub portion and extends across the pocket. The gate is pierced to allow passage of an upper end of the primer therethrough and provides a gas seal with an exterior surface of the primer upon insertion within the pocket.

These and other features and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Shotshell Casing with Prior Art Basewad

Figure 1:
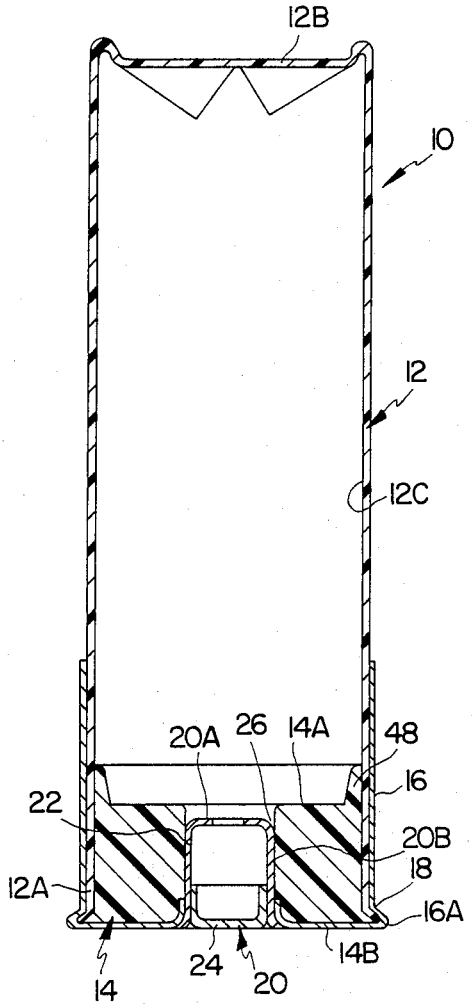
FIG. 1 PRIOR ART
FIG. 1 is a vertical axial sectional view of a prior art shotshell casing.

Referring now to the drawings, and particularly to FIG. 1, there is shown a prior art shotshell casing, generally designated by the numeral 10. Basically, the shotshell casing 10 includes an elongated plastic tube 12 (such as the one known as a Reifenhauser tube), a generally cylindrical plastic basewad 14, and a cup-shaped metal head 16. The plastic basewad 14 is inserted in a tight fitting relation in the bottom end portion 12A of the tube 12. The bottom end portion 12A of the tube 12 with the basewad 14 therein are placed inside of the metal head 16 and mechanically locked thereto in a heading operation by a crimp 18 formed into a peripheral rim 16A at the base of the head 16.

Figure 3:
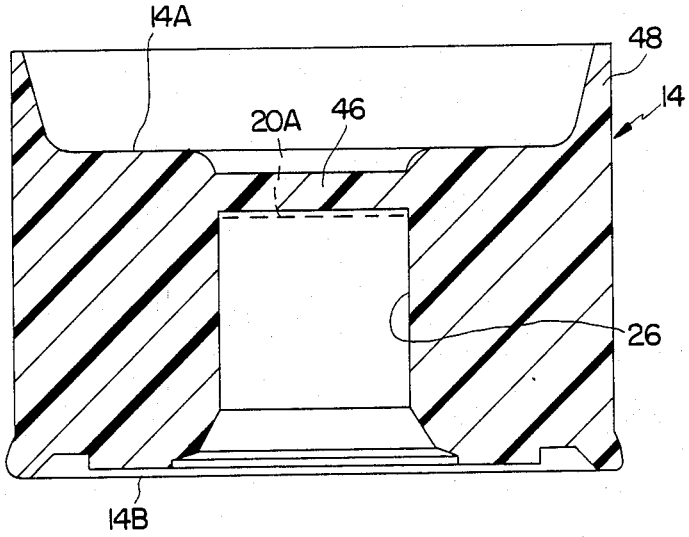
FIG. 3 PRIOR ART
FIG. 3 is a vertical axial sectional view of the basewad of the prior art shotshell casing of FIG. 1.

Also, a primer 20 is provided being composed of a battery cup 22 and a primer cup 24 frictionally fitted into the open bottom of the battery cup with an anvil and primer charge (not shown) located between the cups 22, 24. As also seen in FIG. 3, the basewad 14 has a generally cylindrical central pocket 26 defined therethrough in which the primer 20 is centrally positioned and frictionally fitted rearwardly of a propellant charge (not shown) placed in the interior of the tube 12. Typically, an obturator shot cup (not shown) containing a load of shot (not shown) is housed in the tube forwardly of the propellant charge and the top end 12B of the tube 12 is closed off by an inward fold which extends over the shot load.

Thus, the interior volume of the shotshell casing 10 available for housing the propellant charge and the shot load (including the obturator shot cup) is generally determined by the interior volume of the tube 12 minus the volume of the basewad 14. The interior volume provided by the casing 10 of above-described construction generally is sufficient for housing the desired weight of a lead shot load. However, its interior volume is not sufficient when steel shot is substituted for lead shot.

Shotshell Casing with Reduced Volume Basewad

Figure 2:
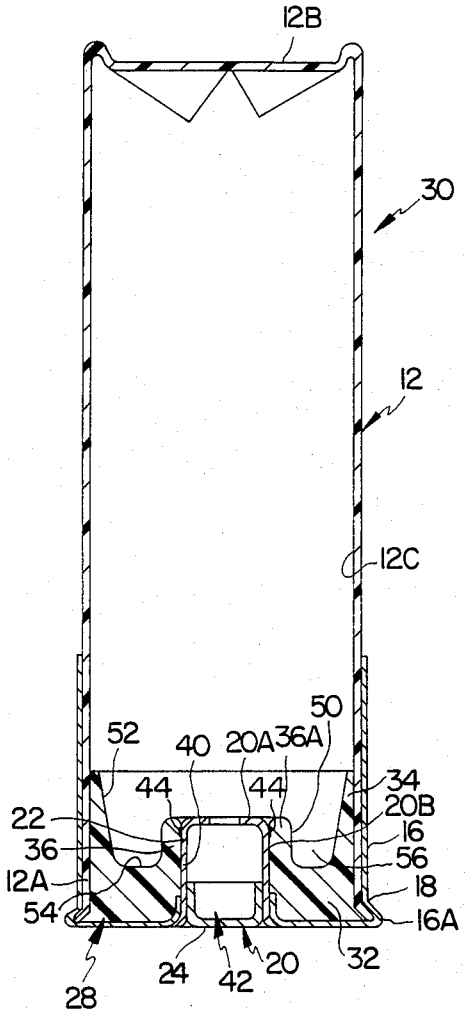
FIG. 2 is a vertical axial sectional view of a shotshell casing having the improved reduced volume basewad of the present invention.
Figure 4:
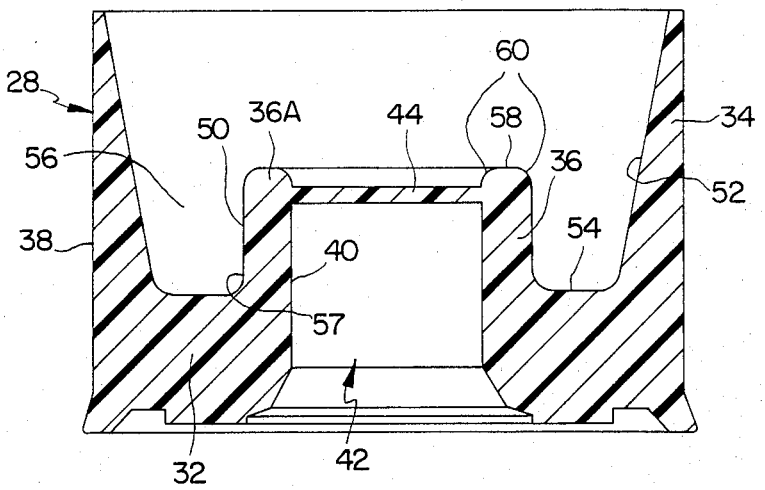
FIG. 4 is a vertical axial sectional view of the improved basewad of the shotshell casing of FIG. 2.

FIGS. 2 and 4, illustrate a preferred embodiment of an improved plastic basewad 28 having a configuration which increases the interior volume of a shotshell casing 30. Except for the basewad 28, the components of the shotshell casing 30 are virtually identical to those of the shotshell casing 10 of FIG. 1 and so are identified with the same reference numerals.

In its basic parts, the improved basewad 28 has a generally solid cylindrical plastic body portion 32, an annular outer continuous skirt portion 34 merging integrally and upwardly from the body portion 32, and a raised annular inner continuous hub portion 36 merging integrally and upwardly from the body portion 32. The skirt and body portions 34, 32 define a continuous cylindrical exterior surface 38 sized relative a cylindrical interior surface 12C of the plastic tube 12 for tightly frictionally fitting within the tube 12 at the bottom end portion 12A thereof providing a gas seal with the tube interior surface 12C. The tube 12 and basewad 28 are mechanically crimped by the head 16 as described above.

The hub and body portions 36, 34 define a continous interior surface 40 forming an elongated pocket 42 for receiving the primer 20 in a tight frictional fitting relation with an upper end 20A of the primer 20 disposed adjacent an upper end 36A of the hub portion 36. The improved basewad 28 is preferably injection molded from a different high density polyethylene resin than the prior art basewad 14.

However, more importantly, the improved basewad 28 has a disk-shaped or wafer-like gate 44 used in injecting molding the basewad which serves an additional function not served by a comparable gate 46 in the prior art basewad 14. The gate 44 in the improved basewad 28 is attached to the interior surface 40 of the hub portion 36 within the primer pocket 42. The gate 44 is spaced a short distance (for example 0.045 inch) below the upper end 36A of the hub portion 36 and extends across the pocket 42. Before the primer 20 is inserted in the pocket 42, the gate 44 is centrally ruptured or pierced to allow passage of the upper end 20A of the primer therethrough. In addition to its function in the injection molding of the basewad 28, the gate 44 functions as a seal providing a gas seal between the exterior surface 20B of the primer 20 and the interior surface 40 of the hub portion 36 of the improved basewad 28. Not only is the prior art gate 46 thicker than the gate 44, the prior art gate 46 did not serve as a seal. In the prior art construction, the upper end 20A of the primer 20 (as represented by the dashed line in FIG. 3) did not extend past the gate 46. Thus, no seal was formed via the ruptured gate 46 between the primer 20 and basewad 14.

Further, the thinner cross-section of the gate 44 reduces the stresses built up at the gate location and moves the location of these stresses to a point where they are less likely to result in failures. The wall thickness of the hub portion 36 being greater than the thickness of the gate 44 (for example, 0.060 inch compared to 0.020 inch) contributes to reduction of stresses propagated in the hub portion. Also, the obturating skirt portion 34 of the improved basewad 28 is longer and thinner compared to a comparable skirt portion 48 on the prior art basewad 14 thereby by improving its gas sealing capability between the tube 12 and the basewad 28.

In the improved basewad 28, the hub and skirt portions 36, 34 are radially spaced from one another with reference to a central longitudinal axis A of the basewad which passes axially through the primer-receiving pocket 42. The hub and skirt portions 36, 34 define respective exterior and interior surfaces 50, 52 which merge with an upper transverse surface 54 of the body portion 32 so as to define therebetween and above the body portion 32 an annular continuous recess or concavity 56. It can be readily appreciated that, in contrast to the thicker basewad 14 having no concavity and (except for the skirt 48) having generally parallel top and bottom surfaces 14A, 14B, the presence of the concavity 56 of the improved basewad 28 increases the interior volume of the casing 20. A lower portion of a propellant charge (not shown) placed in the casing 30 will reside below and rearwardly of the upper end 20A of the primer 20 so as to thereby increase the interior shot load holding volume of the casing 30. Before the origination of the improved basewad 28, conventional thinking was that propellant placed below or being the flame front coming out of the hole in the upper end of the primer would not properly or satisfactorily ignite. However, this was unexpectedly found not to be the case. Conventional thinking also held to the view that the top surface of the basewad had to be forwardly of the primer 20, as in the prior art construction, to properly support the primer. This also was found not to be valid.

Even though the web thickness of the improved basewad 28 (for example 0.130 to 0.170) is now reduced substantially over that of the prior art basewad 14, for example to less than one half, to provide significantly greater interior volume, adequate thickness and strength are still present to lock together the head 18 and tube 12 with the basewad 28.

In one exemplary embodiment, the exterior surface 50 of the hub portion 36 of the improved basewad 28 has a cylindrical configuration extending coaxially with respect to the longitudinal axis A of the basewad 28. The upper transverse surface 54 of the body portion 32 is generally perpendicular to the basewad longitudinal axis A and thus perpendicular to the cylindrical surface 50 on the hub portion 32 and merges therewith at a continuous rounded corner 57. The interior surface 52 of the skirt portion 34 has an inverted truncated conical configuration extending away or diverging from the upper transverse surface 54 of the body portion 32. The upper end 36A of the hub portion 36 has a continuous planar surface 58 bounded by continuous inner and outer edges 60 having rounded configurations. The rounded shape of the hub portion upper end 36A tends to reduce propagation of stresses therein from the gate 44.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely a preferred or exemplary embodiment thereof.

I claim:

1. A plastic basewad for use with a plastic tube of a shotshell casing, said basewad comprising:

(a) a generally solid cylindrical plastic body portion;

(b) an annular outer continuous skirt portion merging integrally and upwardly from said body portion;

(c) a raised annular inner continuous hub portion merging integrally and upwardly from said body portion;

(d) said hub and skirt portions being radially spaced from one another and defining respective spaced continuous exterior and interior surfaces which merge with a continuous upper transverse surface of said body portion so as to define therebetween and forwardly of said body portion an annular continuous concavity for containing rearwardly of an upper end of said hub portion a portion of a propellant charge placed in the tube so as to thereby increase the interior shot load holding volume of the tube;

(e) said hub and body portions defining a continuous interior axial surface forming an elongated pocket receiving a primer in a tight frictional fitting relation with said axial surface, said primer having an upper end disposed adjacent said upper end of said hub portion; and (f) a ruptured disc-shaped injection molding gate integrally attached to said interior surface of said hub portion, said gate cooperating with said primer to provide an annular gas seal between an exterior surface of the primer and the interior surface of said hub portion.

2. The basewad as recited in claim 1, wherein said skirt and body portions define a continuous exterior surface sized relative an interior surface of the plastic tube for tightly frictionally fitting within the tube at a bottom end portion thereof for providing a gas seal with the tube interior surface.

3. The basewad as recited in claim 1, wherein said exterior surface of said hub portion has a cylindrical configuration extending coaxially with respect to a central longitudinal axis of said basewad.

4. The basewad as recited in claim 1, wherein said upper transverse surface of said body portion is generally perpendicular to the central longitudinal axis of said basewad.

5. The basewad as recited in claim 1, wherein said interior surface of said skirt portion has an inverted truncated conical configuration extending away from said upper transverse surface of said body portion.

6. The basewad as recited in claim 1, wherein said upper end of said hub portion has a continuous planar surface bounded by inner and outer edges having rounded configurations.

7. The basewad as recited in claim 1, wherein said exterior surface of said hub portion and said upper transverse surface of said body portion extend generally perpendicular to one another and merge with one another at a rounded corner.

8. A plastic basewad for use with a plastic tube of a shotshell casing, said basewad comprising:

(a) a generally solid cylindrical plastic body portion;

(b) an annular outer continuous skirt portion merging integrally and upwardly from said body portion, said skirt and body portions defining a continuous exterior surface sized relative a continuous interior surface of the plastic tube for tightly frictionally fitting within the tube at a bottom end portion thereof for providing a gas seal with the tube interior surface;

(c) a raised annular inner continuous hub portion having an upper end, said hub portion merging integrally and upwardly from said body portion, said hub and body portions defining a continuous interior axial surface forming an elongated pocket receiving a primer in a tight frictional fitting relation with said axial surface, said primer having an upper end disposed adjacent the upper end of said hub portion;

(d) said hub and skirt portion being radially spaced for one another with reference to a central longitudinal axis of said basewad passing through said primer-receiving pocket, said hub and skirt portions defining respective spaced continuous exterior and interior surfaces which merge with an upper continuous transverse surface of said body portion so as to define therebetween and forwardly of said body portion an annular continuous concavity having a bottom disposed below the elevation of an upper end of said hub portion for containing rearwardly thereof a portion of a propellant charge placed in the tube so as to thereby increase the interior shot load holding volume of the tube; and (e) a ruptured disc-shaped injection molding gate attached to said interior surface of said hub portion and being spaced below said upper end thereof, said gate coacting with an exterior surface of the primer to provide a gas seal between said interior surface of said hub and said exterior surface of said primer.

9. The basewad as recited in claim 8, wherein said exterior surface of said hub portion has a cylindrical configuration extending coaxially with respect to said central longitudinal axis of said basewad.

10. The basewad as recited in claim 8, wherein said upper transverse surface of said body portion is generally perpendicular to said central longitudinal axis of said basewad.

11. The basewad as recited in claim 8, wherein said interior surface of said skirt portion has an inverted truncated conical configuration extending away from said upper transverse surface of said body portion.

12. The basewad as recited in claim 8, wherein said upper end of said hub portion has a continuous planar surface bounded by inner and outer edges having rounded configurations.

13. The basewad as recited in claim 8, wherein said exterior surface of said hub portion and said upper transverse surface of said body portion extend generally perpendicular to one another and merge with one another at a rounded corner.

14. In a shotshell casing having an elongated plastic tube and a metal primer, a plastic basewad comprising:

(a) a generally solid cylindrical plastic body portion;

(b) an annular outer continuous skirt portion merging integrally and upwardly from said body portion, said skirt and body portions defining a continuous exterior surface sized relative an interior surface of said plastic tube for tightly frictionally fitting within said tube at a bottom end portion thereof for providing a gas seal with the tube interior surface;

(c) a raised annular inner continuous hub portion merging integrally and upwardly from said body portion, said hub and body portions defining a continuous interior surface forming an elongated pocket receiving said primer in a tight frictional fitting relation with an upper end of said primer disposed adjacent an upper end of said hub portion; and (d) a ruptured injection molding gate attached to said interior surface of said hub portion and spaced below said upper end thereof coacting with said primer to provide an annular gas seal between said interior surface of said hub portion and an exterior surface of said primer;

(e) said hub and skirt portions being radially spaced from one another with reference to a central longitudinal axis of said basewad passing axially through said primer-receiving pocket, said hub and skirt portions defining respective exterior and interior surfaces which merge with an upper surface of said body portion so as to define between said hub and skirt portions and above said body portion an annular continuous concavity having a bottom disposed below the elevation of upper ends of said hub portions and primer for containing rearwardly thereof a portion of a propellant charge when placed in the tube so as to thereby the increase shot load holding volume of the tube.

15. The shotshell casing as recited in claim 14, wherein said exterior surface of said hub portion has a cylindrical configuration extending coaxially with respect to said longitudinal axis of said basewad.

16. The shotshell casing as recited in claim 14, wherein said upper transverse surface of said body portion is generally perpendicular to said longitudinal axis of said basewad.

17. The shotshell casing as recited in claim 14, wherein said interior surface of said skirt portion has an inverted truncated conical configuration extending away from said upper transverse surface of said body portion.

18. The shotshell casing as recited in claim 14, wherein said upper end of said hub portion has a continuous planar surface bounded by inner and outer edges having rounded configurations.

* * * * *